US008136559B2

(12) United States Patent
Rosenau et al.

(10) Patent No.: US 8,136,559 B2
(45) Date of Patent: Mar. 20, 2012

(54) PLANER

(75) Inventors: Isabell Rosenau, Dreieich (DE); Ian Bell, Berkshire (DE)

(73) Assignee: Black & Decker Inc., Newark, DE (US)

( * ) Notice: Subject to any disclaimer, the term of this patent is extended or adjusted under 35 U.S.C. 154(b) by 19 days.

(21) Appl. No.: 12/455,079

(22) Filed: May 27, 2009

(65) Prior Publication Data

US 2009/0293991 A1 Dec. 3, 2009

(30) Foreign Application Priority Data

May 28, 2008 (GB) ..... 0809621.6

(51) Int. Cl.
*B27C 1/10* (2006.01)

(52) U.S. Cl. ..... 144/154.5; 144/48.5; 30/475

(58) Field of Classification Search ..... 144/136.95, 144/154.5, 48.5, 48.6; 30/475, 476
See application file for complete search history.

(56) References Cited

U.S. PATENT DOCUMENTS

| | | | | | |
|---|---|---|---|---|---|
| 790,533 | A | * | 5/1905 | Shontz | 30/491 |
| 1,706,157 | A | * | 3/1929 | Hannah | 30/475 |
| 2,672,172 | A | * | 3/1954 | Godfrey et al. | 30/475 |
| 2,871,897 | A | * | 2/1959 | Hesse et al. | 30/475 |
| 4,335,768 | A | * | 6/1982 | Bachmann | 30/475 |
| 4,555,850 | A | | 12/1985 | Frech | |
| 4,648,468 | A | | 3/1987 | Honsa | |
| 4,693,648 | A | | 9/1987 | Cavedo | |
| 4,700,481 | A | * | 10/1987 | Barrett | 30/475 |
| 5,094,000 | A | * | 3/1992 | Becht et al. | 30/475 |
| D607,291 | S | * | 1/2010 | Rosenau | D8/62 |
| 2005/0034782 | A1 | * | 2/2005 | Park et al. | 144/154.5 |
| 2005/0284543 | A1 | * | 12/2005 | Kaiser | 144/373 |

FOREIGN PATENT DOCUMENTS

| | | | |
|---|---|---|---|
| DE | 1855677 | U | 7/1962 |
| DE | 3600882 | A1 | 7/1987 |
| EP | 0581920 | A1 | 9/1994 |
| EP | 0878280 | A2 | 11/1998 |
| GB | 2419564 | A | 3/2006 |

OTHER PUBLICATIONS

Search Report for UK patent application No. GB0809621.6, dated Aug. 19, 2008, by Gareth Prothero.

* cited by examiner

*Primary Examiner* — Shelley Self
(74) *Attorney, Agent, or Firm* — Rhonda L. Barton; Scott B. Markow; Adan Ayala

(57) ABSTRACT

A hand held electrically powered planer including a housing; an electric motor mounted within the housing; a work piece engaging shoe mounted on the underside of the housing having an aperture formed therethrough; and a cutting drum rotatably mounted within the housing, which is capable of being rotatably driven by the electric motor when the electric motor is activated. A part of the cutting drum protrudes through the aperture to engage a work piece. A cutting blade is mounted on the cutting drum. A rear handle is mounted on the housing and includes an elongate shaft attached at one end only to the rear of the housing and extends forward in a lengthwise direction over a portion of the housing toward the front end of the housing. A grip is mounted or formed on the elongate shaft and there is a front handle which is mounted on the free end of the shaft forward of the grip.

9 Claims, 11 Drawing Sheets

PLANER

FIELD OF THE INVENTION

The present invention relates to a battery powered hand held planer.

BACKGROUND OF THE INVENTION

A known type of hand held planer for removing the surface of a workpiece such as a wooden door is shown in FIG. 1. The planer 2 has a housing 4 having a rear handle 6, provided with a trigger switch 8 for supplying electrical power via a power supply cable 10 to an electric motor 12, and a front handle 14. A shoe 16 having a part-cylindrical recess 19 is mounted to and flush with the bottom 20 of the housing 4. A planer cylinder 22 having a pair of diametrically opposed blades 24 is rotatably mounted in the recess 19 so that the surface of the planer cylinder 22 protrudes slightly from the recess 19 through an aperture 18 in the underside of the shoe 16 in order to engage a workpiece (not shown) when the planer 2 rests on the workpiece. The motor 12 has an output shaft 26 which is connected via a drive belt 28 to the planer cylinder 22 such that the planer cylinder 22 is driven at lower rotational speed and higher torque than the output shaft 26 of the motor 12. When the planer cylinder 22 is driven by the motor 12 via the belt 28, the blades 22 contact and remove material from the surface of the work piece. GB2299051 and EP1428620 disclose such a hand held planer.

Another type of hand held planer will now be described with reference to FIGS. 2 to 13. A battery hand held powered planer 102 is shown in FIGS. 2 and 3. The planer 102 has housing 104 defining a rear handle 106 having a trigger switch 108 for supplying electrical power from a rechargeable battery 110 to an electric motor 112, and including a workpiece engaging surface 137 which rests against a workpiece when the planer is in use.

As shown in greater detail in FIG. 3, the motor 112 is a brushless type motor and has a central stator 114 carrying field windings 116 which are energized via leads 118 connected to battery 110 via an electronic power module (not shown) controlling the timing of tenderization of the field windings 116. The stator 114 is fixed to a bracket 120 on the housing 104 via end caps 122, 124 and screws 126 such that the stator 114 is non-rotatably mounted relative to the housing 104. One of the end caps 124 has an elongate aperture 128 for allowing connection of the leads 118 to the electronic power module.

The motor 112 also includes a rotor 130 in the form of a planer cylinder coaxially arranged around the stator 114 and having a pair of planer blades 132 on its outer surface and permanent magnets 134 arranged around its inner surface. Part of the outer surface of the planer cylinder 130 protrudes through an aperture 136 in a shoe 138 in the lower surface of the housing 104 such that when the field windings 116 on the stator 114 are energized, the rotor 130 rotates relative to the stator 114 and the housing 104 and the blades 132 engage a workpiece on which the planer 102 rests to remove surface material from the workpiece.

The battery 110 is slidably mounted in the housing 104 above the workpiece engaging surface 137 in the direction of arrow A in FIG. 3, and the weight of the various component parts is so distributed that when the planer 102 is held by the rear handle 106, the centre of mass of the planer 102 hangs vertically below the trigger switch 108. In particular, the position of the battery has been arranged so that the weight of the battery counterbalances the weight of the motor. In this way, the planer 102 can be conveniently placed on a workpiece with the shoe 138 and lower workpiece engaging surface 137 of the housing 104 arranged parallel to the workpiece. In this way, a user can easily place the planer 102 on a workpiece with minimum discomfort to the user or risk of damage to the workpiece. It can be seen that the battery 110 occupies the space within the housing 104 occupied by the motor in known types of belt driven planers, as a result of which the front to back length of the planer 102 of the present invention is less than that of known battery powered belt driven planers. Furthermore, it can be seen in FIG. 2 that the battery 110 is located above the work piece engaging surface 137.

A claw pole motor is one possible choice of electric motor. Electrical machines with claw pole armatures offer high specific torque output using very simple and easily manufactured coils and soft magnetic components. An example of a claw pole motor for use in the planer 102 of FIGS. 2 and 3 is now described with reference to FIGS. 4 to 12. The claw pole motor 112 includes a stator 42, including a central shaft 56 with a channel 57 and three electrically independent claw pole stator elements 581, 582, 583. Each stator element includes a substantially circular first half-claw member 60 having a first central element 66 and eight claws 64 and a substantially circular second half-claw member 62 having a second central element 68 and eight claws 64. Both half-claw members 60, 62 are substantially the same, but opposing, and the eight claws 64 of each half-claw member 60, 62 are arranged in equi-angular intervals around the perimeter of the substantially circular half-claw members 60, 62, such that when the first central element 66 and the second central element 68 are joined together the claws 64 juxtapose each other, thereby forming an outer cylindrical drum of sixteen axially aligned claws 64. A field coil 70 of insulated copper wire, preferably formed in the shape of a simple hoop, the field coil 70 is situated within the cylindrical space enclosed by the sixteen juxtaposed claws 64 and surrounds the central elements 66, 68 of the two joined half-claw members 60, 62. The field coil 70 is insulated from the half-claw members 60, 62 and is connected to the power module 30 by two field coil wires 721, 722 which exit an assembled claw pole stator element 581, 582, 583 via a gap between two claws 64, or through a hole in one of the central elements 66, 68. A rotor drum 40 includes a cylindrical drum 74 with a circular end face 75, 77 at each end and sixteen permanent magnets 76. Each end face 75, 77 includes a bearing 79, 81) mounted upon the shaft 56 and a plurality of fins 83 disposed on the outside of the end face 75, 77. The cylindrical drum 74 is supported by the end faces 75, 77 and bearings 79, 81 for rotational movement about the shaft 56. Sixteen magnetic poles are formed by the sixteen permanent magnets 76, each permanent magnet 76 being attached to the inner surface 78 of the cylindrical drum 74 and extending continuously along its axial length.

The half-claw members 60, 62 are made of a ferromagnetic material. The preferred choice of material for the half-claw members 60, 62 is a composite of soft iron powder, the soft iron powder being pre-coated in an insulating epoxy resin and held together by a bonding process to produce an isotropic ferromagnetic material. The first stage of this process is the compression of the soft iron powder composite into a mould shaped like a half-claw member. At this stage the powder is not yet bonded together and the half-claw member formed within the mould would disintegrate if removed from the rigid confines of the mould. The next stage of the process involves heating the powder to a temperature at which the epoxy resin fuses thereby linking together the soft iron powder particles. The final stage of the bonding process involves the soft iron powder composite cooling to a temperature at which the epoxy resin solidifies thereby permanently and solidly bonding the soft iron powder particles together into the shape of a half-claw member. A half-claw member 60, 62 made of this type of soft iron composite benefits from a significant reduction in the iron losses caused by eddy currents, when compared to the solid mild steel structures commonly used for conventional claw pole cores. This is due to the epoxy resin forming an insulating layer between soft-iron powder particles which acts as a barrier inhibiting the circular flow of eddy currents that would normally be formed by an alternating magnetic field within the body of the half-claw members 60, 62. Overall, the extremely low iron loss due to eddy currents is comparable to that of laminated steels, however claw pole members 60, 62 made from laminated steel would be more difficult and therefore more costly to make than one made of the soft iron composite.

Construction of a claw pole stator element 581, 582, 583 begins with the assembly of two half-claw members 60, 62 so that they are joined at their central elements 66, 68 and reversed in such a way that their claws 64 juxtapose but do not touch each other, the claws 64 enclosing a cylindrical space occupied by the field coil 70. At this stage of assembly the half-claw members 60, 62 are only held together by an assembly device (not shown) and, before progressing further, provision must be made for an exit point for the field coil wires 721, 722 leading from the field coil 70 to the power module 30. The preferred means for uniting the two half-claw members 60, 62 and field coil 70 is by a process called 'potting'. Potting of a claw pole stator element 581, 582, 583 involves impregnation of all air gaps between the two half-claw members 60, 62 and field coil 70 with a liquid resin, the resin later solidifying and hardening to rigidly bond these parts together. Once the potting process has been completed the assembly device can be removed because the bond formed by the solidified resin is strong enough to hold the claw pole stator element 581, 582, 583 permanently intact.

The stator 42 of the claw pole motor includes three substantially identical claw pole stator elements 581, 582, 583, each one fixedly and concentrically disposed upon a shaft 56, the shaft 56 preferably being formed of non-magnetic material so as to minimize magnetic flux leakage between adjacent claw pole elements 581, 582, 583. The channel 57 extends along the full length of the shaft 56. The channel 57 is sufficiently wide and deep to provide a passage for the field coil wires 721, 722 between the claw pole stator elements 581, 582, 583 and the exterior of the claw pole motor. The channel 57 is sealed at one end by a plug (not shown). The channel 57 is sealed at the other end by a rubber gland, or the like, (not shown) where the field coil wires 721, 722 exit the channel 57. The plug and gland prevent entry of foreign particulate matter into the interior of the claw pole motor via the channel 57. In the embodiment shown in FIG. 11 the channel is arranged upon the surface of the shaft 56. However the channel 57 may be in the form of an internal channel or passage extending along the full length of the centre of the shaft 56. Each of the sixteen magnetic poles of a claw pole stator element 581, 582, 583 is misaligned by 30° (about the axis of the shaft 56) relative to the equivalent magnetic pole of the neighboring claw pole stator element 581, 582, 58), and this alignment gives the stator 42 a 'stepped' appearance. The stepped alignment of the three claw pole stator elements 581, 582, 583 relative to each other, as described above, effectively results in the stator 42 having a total of forty-eight magnetic poles (3×16 magnetic poles), meaning that the permanent magnets 76 of the rotor drum 40 travel less rotational distance between magnetic poles of the stator 42 than they would if the sixteen magnetic poles of each of the three claw pole stator elements 581, 582, 583 were located in-line. The battery 110, when supplied to the stator elements 581, 582, 583, produces a rotating magnetic field within the stator 42 capable of turning the rotor drum 40 with a very low level of cogging, this due to diminished rotational distance between the magnetic poles of the stator 42. 'Cogging' is a term used to describe non-uniform movement of the rotor such as rotation occurring in jerks or increments, rather than smooth continuous motion. Cogging arises when the poles of a rotor move from one pole of the stator to the next adjacent pole and is most apparent at low rotational speeds.

The cylindrical drum 74, end faces 75, 77 and bearings 79, 81 collectively surround the inner space of the rotor drum 40 in an air-tight manner such that the stator elements 581, 582, 583 and permanent magnets 76 are shielded from the entry of foreign particulate matter. During operation of the planer 102 the fins 83 rotate with the end faces 75, 77 and cylindrical drum 74 about the central shaft 56 to create additional air-flow in the region of the rotor drum 40 to cool the rotor drum 40 and its internal components. Furthermore, the cylindrical drum 74 is axially fixed along its full length with respect to the shaft 56 by the end faces 75, 77 and bearings 79, 81 located at each end. The end faces 75, 77 and bearings 79, 81 prevent axial loads applied to the exterior of the rotor drum 40 from axially deflecting any part of the rotor drum 74 toward the shaft 56, thus preventing damaging rubbing contact between the stator elements 581, 582, 583 and the rotating permanent magnets 76. The cylindrical drum 74 is also longitudinally fixed with respect to the shaft 56 by the end faces 75, 77 and bearings 79, 81. However, longitudinal forces applied to the rotor drum 40 are likely to be smaller than axial forces applied to the rotor drum 40 during use of the planer 102.

The electric motor of a power tool may be directly driven by a domestic mains electrical supply or a battery electrical supply. However, power tools, like for example a wood planer, frequently use a power module to drive its electric motor in order to benefit from better control and efficiency that a power module may provide. Power modules capable of receiving a domestic mains electrical supply or a battery electrical supply and converting it into dc or ac, single phase or multiple phase supply, suitable for powering various types of electric motors are well known to the skilled person in the art.

All of the types of planer described previously have substantially the same design of the rear and front handles. The rear handle typically includes a loop which extends lengthwise from the rear of the main housing, forward above the housing, and connects to the housing partway along the housing. The front handle is formed separately from the rear housing and is mounted on the front of the housing.

DE3600882, EP0878280, WO93/15885, U.S. Pat. Nos. 4,693,648 and 4,555,850 disclose planers having a rear handle including an elongate shaft attached at one end to the rear of the housing. However, will these patents disclose planers having a separate front handle mounted directly onto the front of the housing.

BRIEF SUMMARY OF THE INVENTION

The present invention seeks to provide an improved design for the rear and front handles of a hand held planer. Accordingly, there is provided a hand held electrically powered planer including a housing; an electric motor mounted within the housing; a work piece engaging shoe mounted on the underside of the housing having an aperture formed through it; a cutting drum 306 rotatably mounted within the housing, which is capable of being rotatably driven by the electric motor when the electric motor is activated, wherein a part of the cutting drum 306 protrudes through the aperture to engage with a work piece; a cutting blade mounted on the cutting drum; a rear handle mounted on the housing wherein; the rear handle includes an elongate shaft attached at one end only to the rear of the housing and which extends forward in a lengthwise direction over a portion of the housing toward the front end of the housing; and a grip mounted or formed on the elongate shaft, wherein there is provided a front handle which is mounted on the free end of the shaft forward of the grip.

The shaft can be resiliently mounted on the housing to allow the grip and the front handle to move against a biasing force toward or away from the housing. By constructing it in this manner, vibration damping can be provided for both of the front and rear handles.

Alternatively, at least a part of the shaft can be resilient to allow the grip and/or front handle to move against a biasing force toward or away from the housing. Dependant on which part of the shaft is resistant, vibration dampening can be provided for just the front handle or both handles.

BRIEF DESCRIPTION OF THE DRAWINGS

Two preferred embodiments of the invention will now be described, by way of example only and not in any limitative sense, with reference to the accompanying drawings in which.

DETAILED DESCRIPTION OF THE INVENTION

Figure 1:
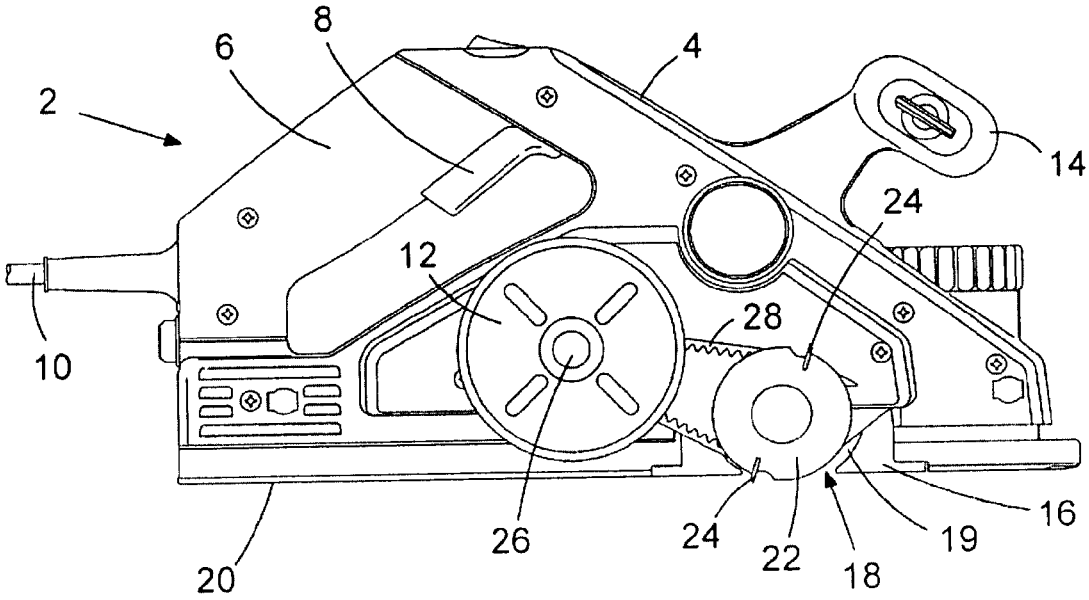
FIG. 1 is a cross sectional elevational view of a known hand held power planer.
Figure 2:
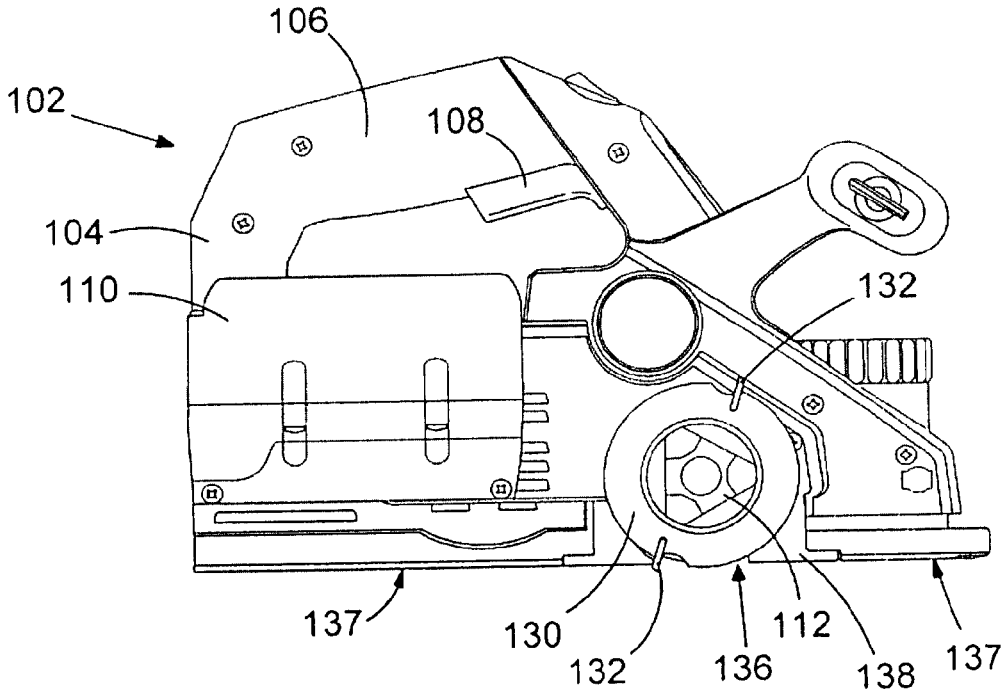
FIG. 2 is a cross section elevation view of another design of battery powered planer.
Figure 3:
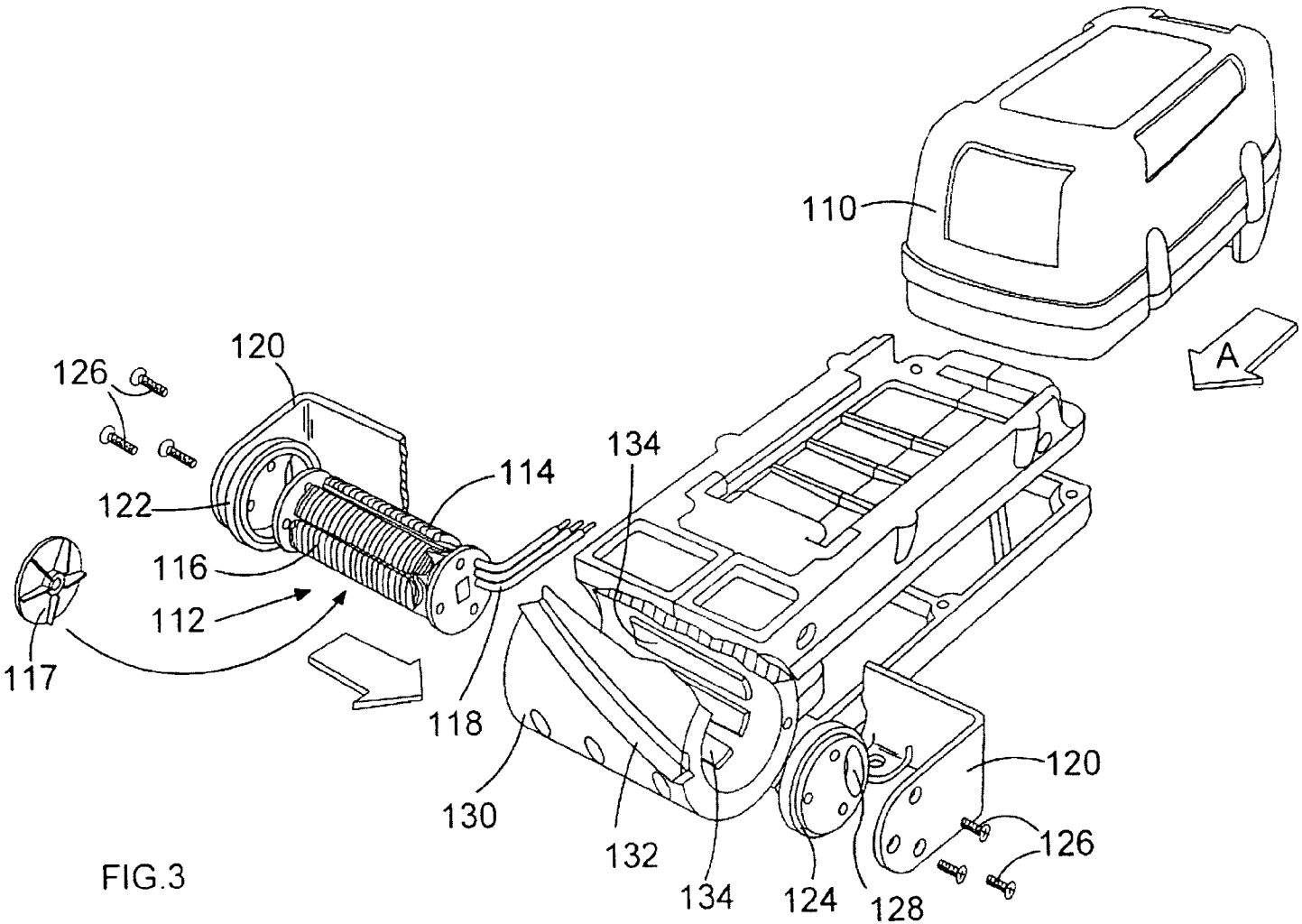
FIG. 3 is an exploded view of the planer of FIG. 2 with the upper part of the housing removed.
Figure 4:
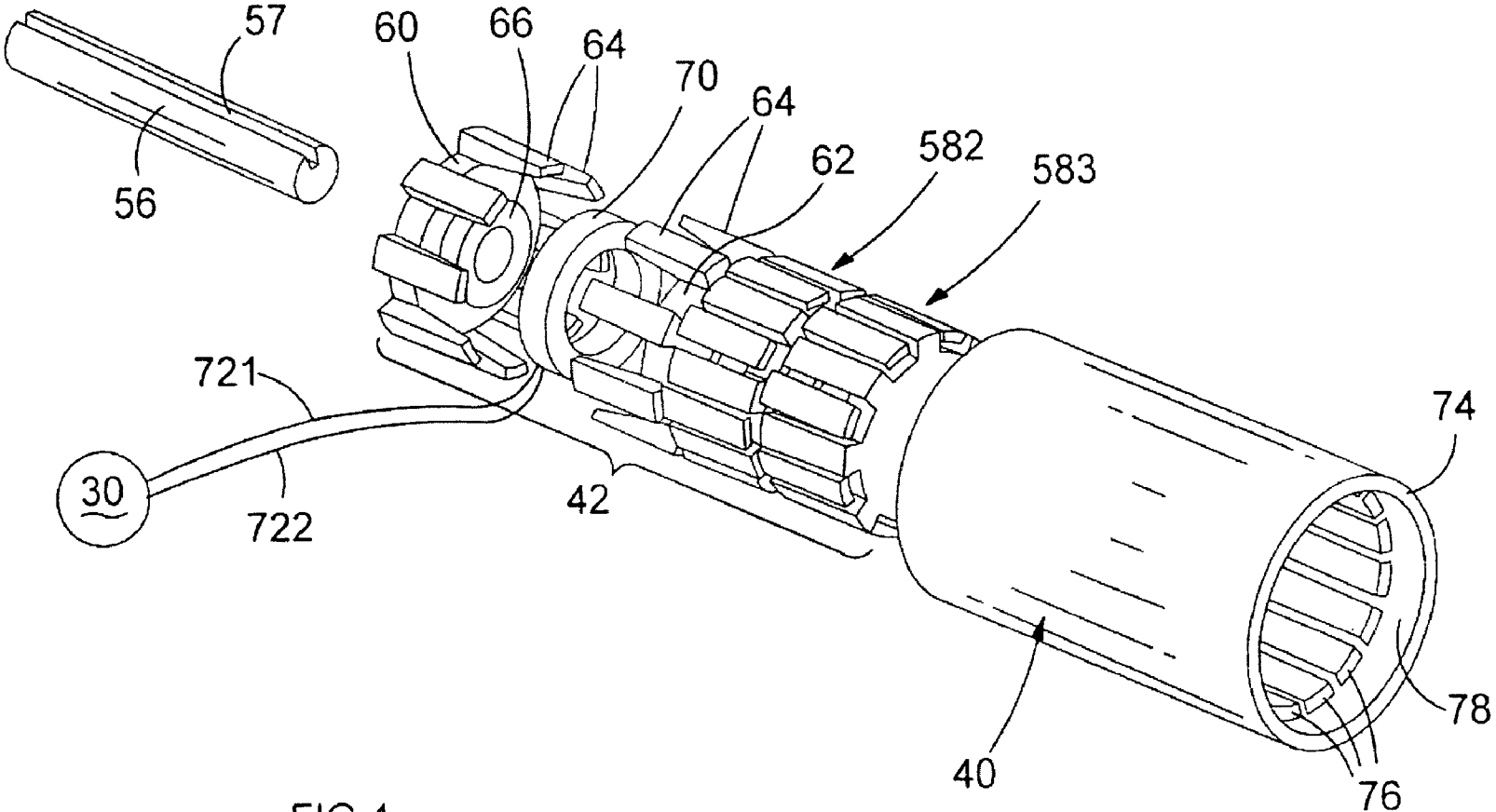
FIG. 4 shows an exploded perspective view of a claw pole motor including two assembled and one disassembled claw pole stator elements, a motor shaft and an external rotor drum.
Figure 5:
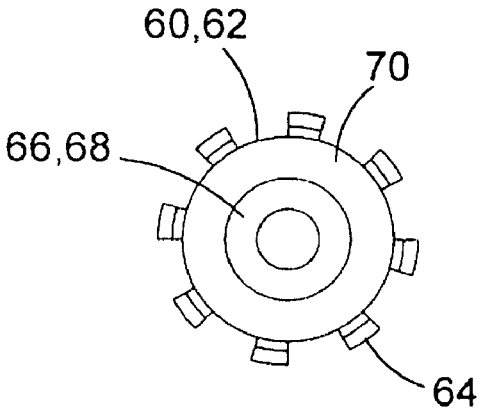
FIG. 5 shows a front elevation view of a half-claw member.
Figure 6:
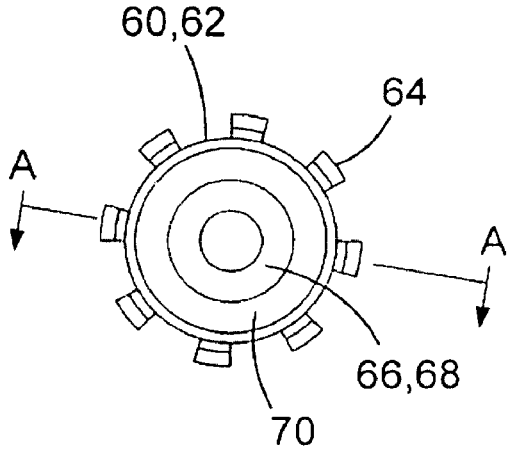
FIG. 6 shows a front elevation view of a half-claw member and field coil.
Figure 7:
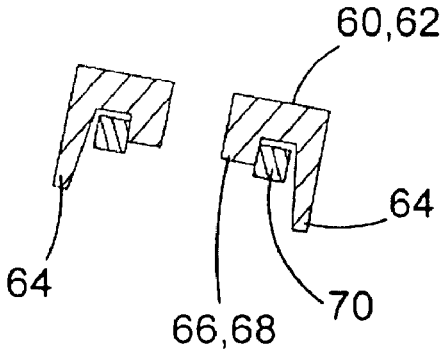
FIG. 7 shows a cross-sectional view A-A of the half-claw member and field coil shown in FIG. 6.
Figure 8:
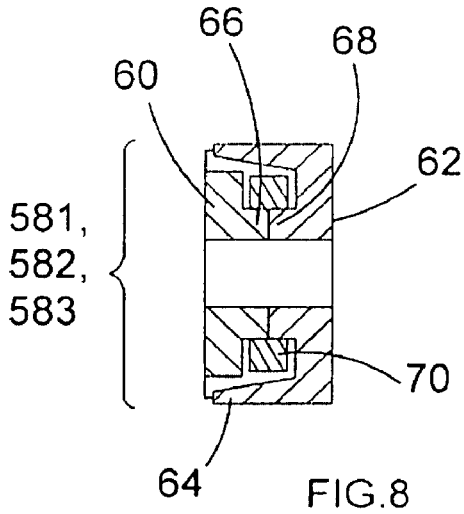
FIG. 8 shows a cross-sectional view of one stator element including two half-claw members joined to enclose a field coil.
Figure 10:
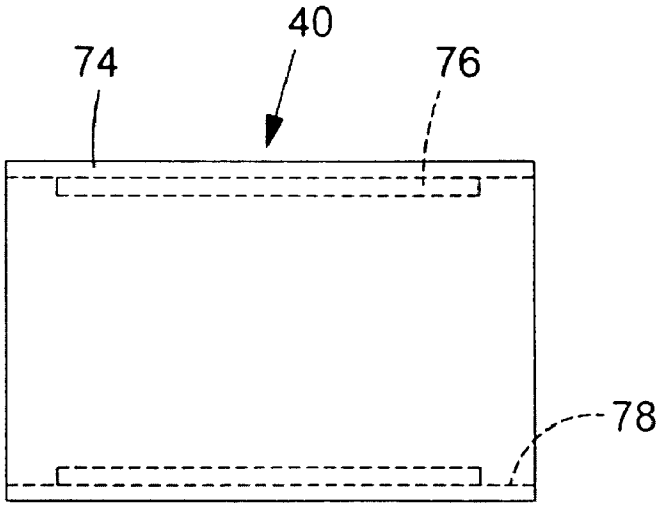
FIG. 10 shows a side elevation view of a rotor drum.
Figure 9:
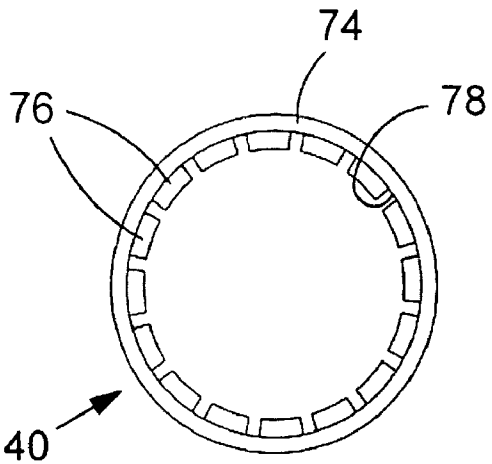
FIG. 9 shows a front elevation view of a rotor drum.
Figure 12:
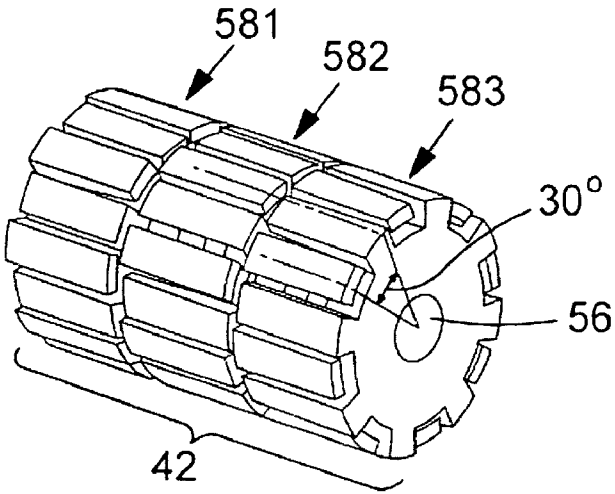
FIG. 12 shows a perspective view of a stator including three stator elements.
Figure 11:
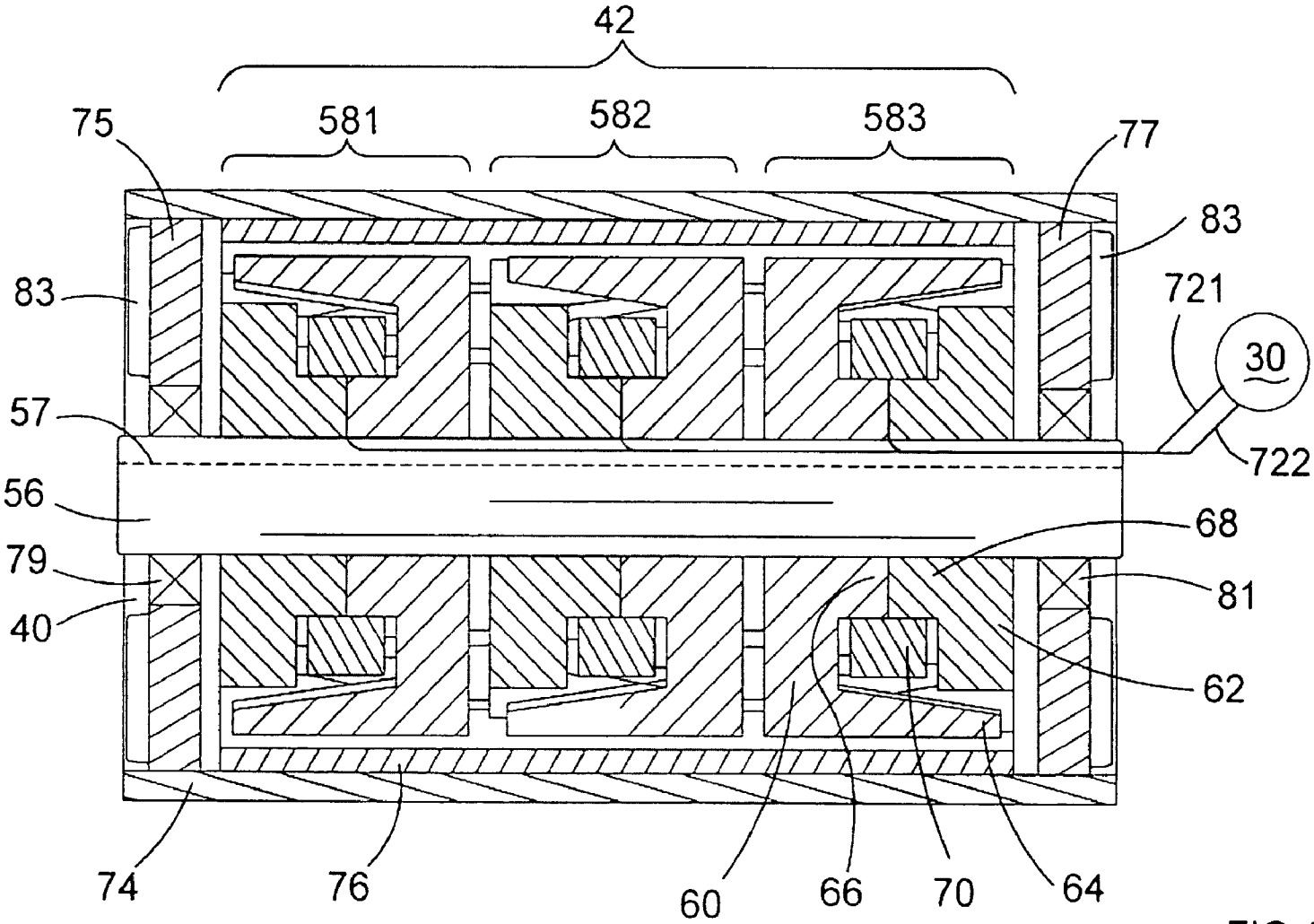
FIG. 11 shows a cross-sectional view of a claw pole motor including rotor drum including end faces with bearings and three stator elements mounted upon a shaft.
Figure 13:
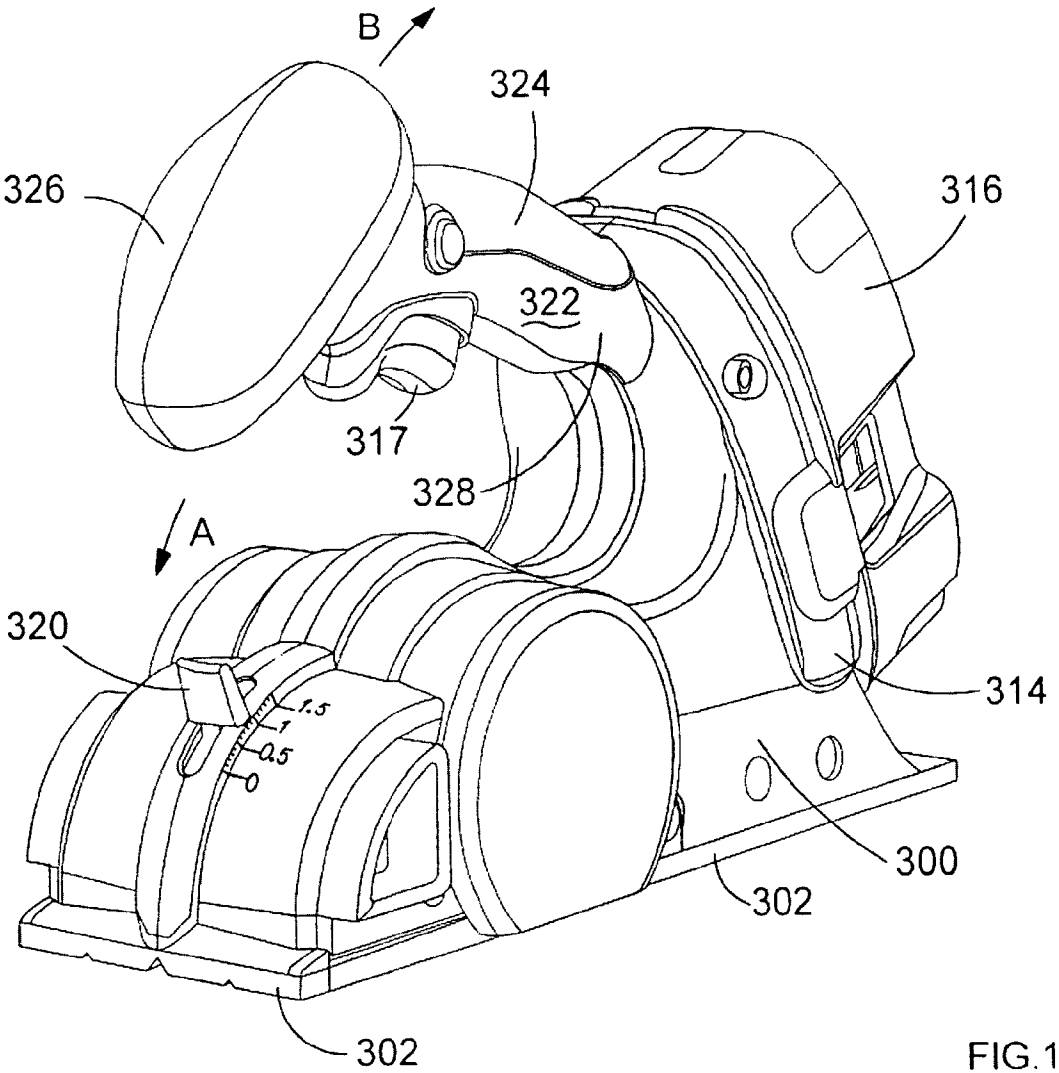
FIG. 13 shows a perspective view of a planer according to the first embodiment of the present invention.
Figure 14:
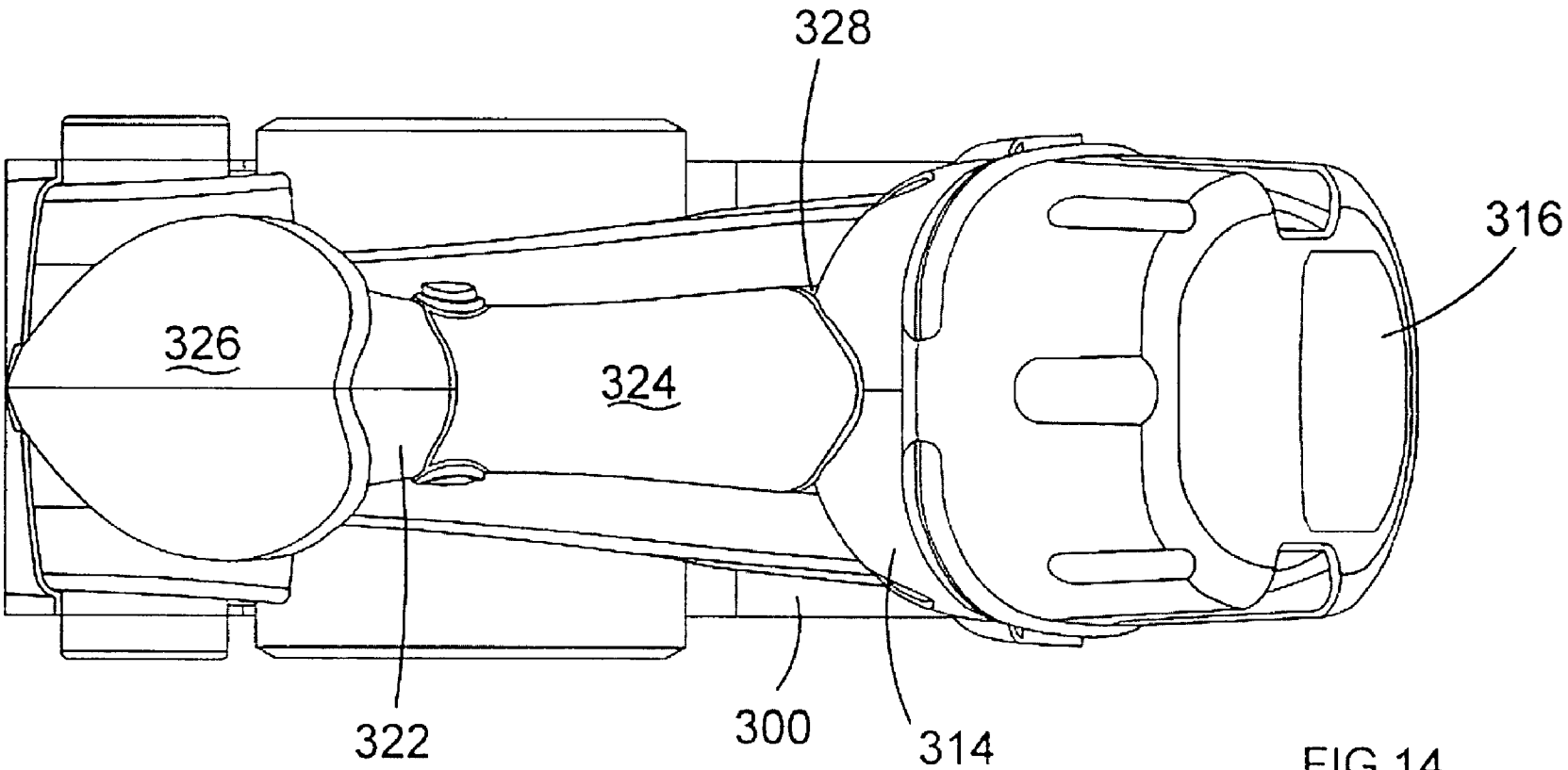
FIG. 14 shows a top view of the planer according to the first embodiment of the present invention.
Figure 15:
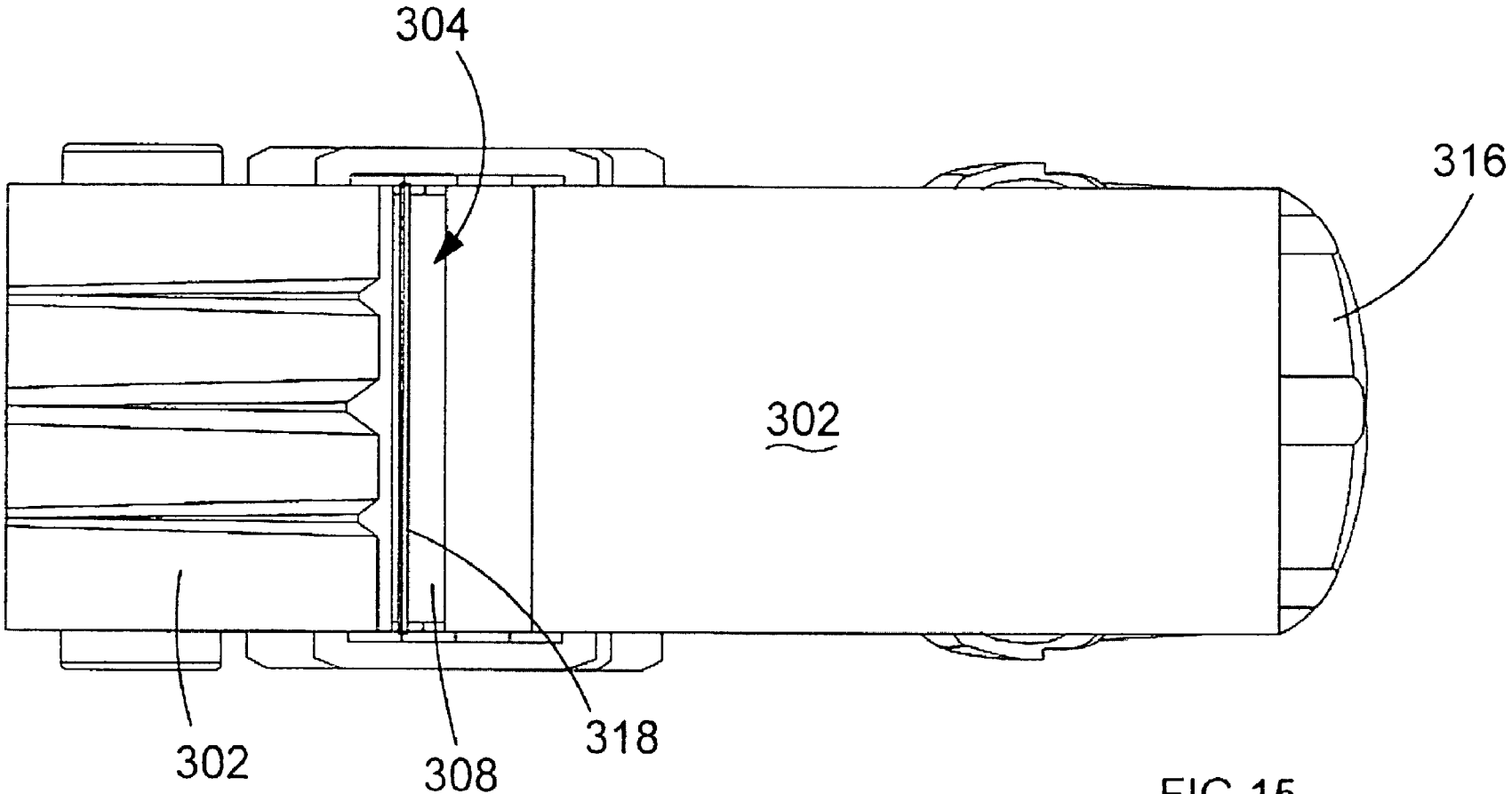
FIG. 15 shows an underside view of the planer according to the first embodiment of the present invention.

Referring to FIGS. 13 to 16, the hand held electrically power planer includes a housing 300. Attached to the underside of the housing 300 is a work piece engaging shoe 302 through which is formed an aperture 304. The shoe 302 rests against a work piece when the planer is in use. Rotatably mounted within the housing 300 is a cutting drum (indicated by dashed lines 306 in FIG. 16). A part 308 of drum 306 protrudes through the aperture 304 in the shoe 302. A cutting blade 318 is rigidly attached to the drum 306. An electric motor (indicated by dashed lines 310 in FIG. 16) is mounted within the housing 300. The motor 310 rotatingly drives the cutting drum 306 via a rubber belt (shown by dashed lines 312 in FIG. 16) when activated in a similar manner to the planer described previously with reference to FIG. 1. The motor is powered by a battery pack 316 releasably mounted on to the rear 314 of the housing 300. The battery 316 is in electrical contact with the motor 310 via a trigger switch 317. Depression of the trigger switch 317 provides an electrical connection between the battery 316 and the motor 310 and thereby activates the motor 310 which in turn rotatingly drives the cutting drum 306 in well known manner. As the drum 306 rotates, the cutting blade 318 repetitively passes through the aperture 304 to cut the work piece. A knob 320 is slidably mounted on the front of the housing 300. Movement of the knob 320 results in the adjustment of the height of the front of the shoe 302, forward of the aperture 304, relative to the housing.

Figure 16:
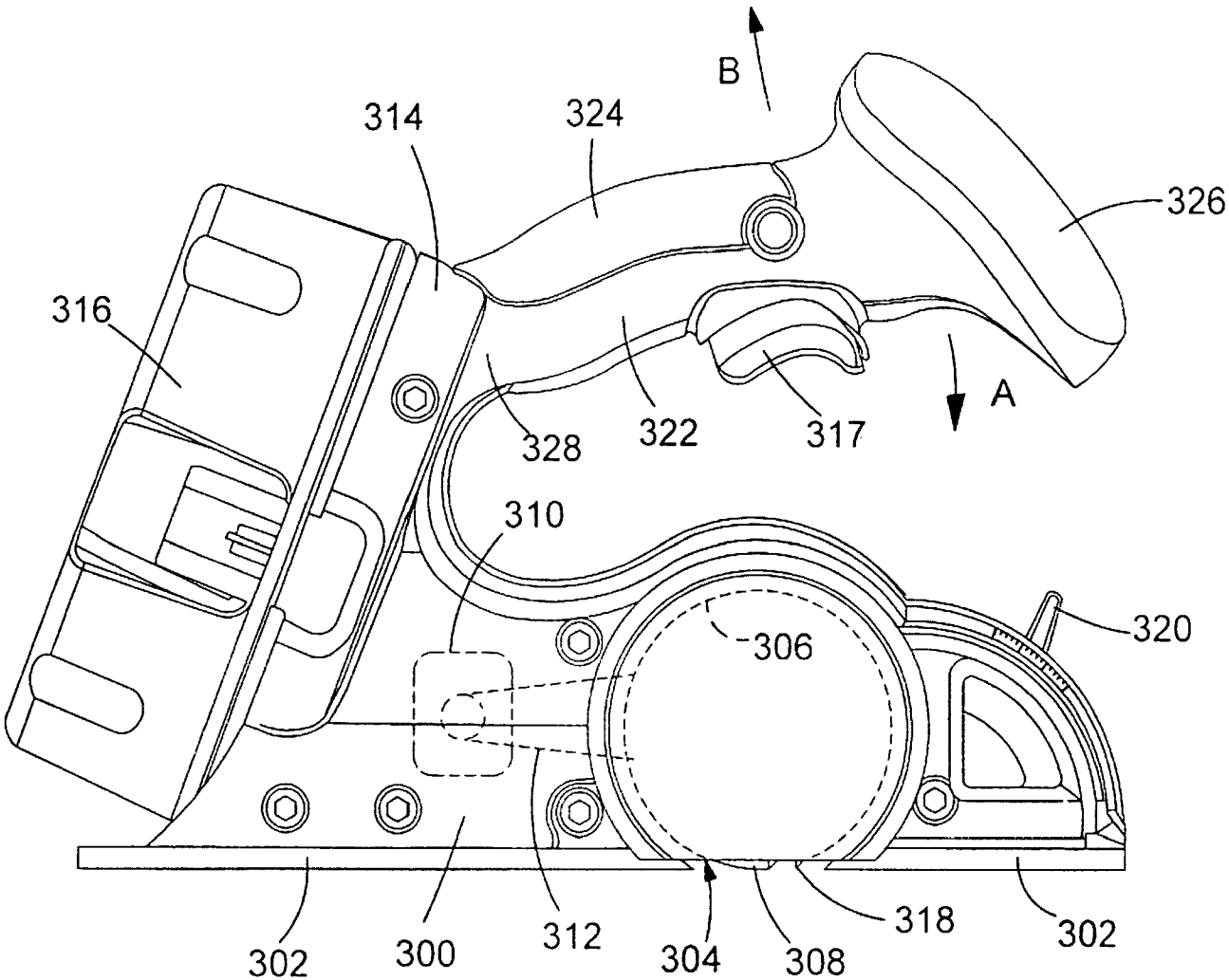
FIG. 16 shows a side view of the planer according to the first embodiment of the present invention.

The rear handle includes an elongate shaft 322 which is attached at one end to the rear part 314 of the housing 300. The shaft 322 extends in a forward direction, along the length of the housing 300, over the top of the housing 300 as best seen in FIG. 16. A grip 324 is mounted on the shaft 322 by which an operator grasps the shaft 322. The grip 324 is ideally molded to the shape of the hand of an operator for comfort. Alternatively, the grip could be integrally formed with the shaft 322. The front handle 326 is integrally formed on the free end shaft 322. The trigger switch 317 is also mounted on the underside of the shaft 322.

The shaft 322 is constructed so that it can flex toward the housing 300 (Arrow A) or away from the housing (Arrow B) when pressure is applied to the shaft 322. The flexibility is generated by making the part 328 of the shaft 322 that connects to the rear 314 of the housing 300 resilient, allowing the shaft 322 to bend at this point 328. It will be appreciated that the whole of the shaft could be made in a resilient manner to allow bending any where along its length.

In use, the operator would grasp the shaft 322 via the grip 324 with one hand and the front handle 326 with the other hand in order to use the planer. The operation of the planer is the same as that of a conventional planer, the operator squeezing the trigger switch 317 to switch it on. When the operator presses the shoe 302 against a work piece, the pressure on the shaft 322 will cause it to flex moving the grip 324 and the front handle 326 toward the housing 300 slightly. As the planer cuts the work piece, the cutting action of the blade 318 generates vibration in the housing 300. However, due to the shaft 322 being connect to the housing 300 with a resilient part 328, the amount of vibration transmitted to the shaft 322 from the housing is reduced, the resilient part 328 acting as a vibration dampener.

Figure 17:
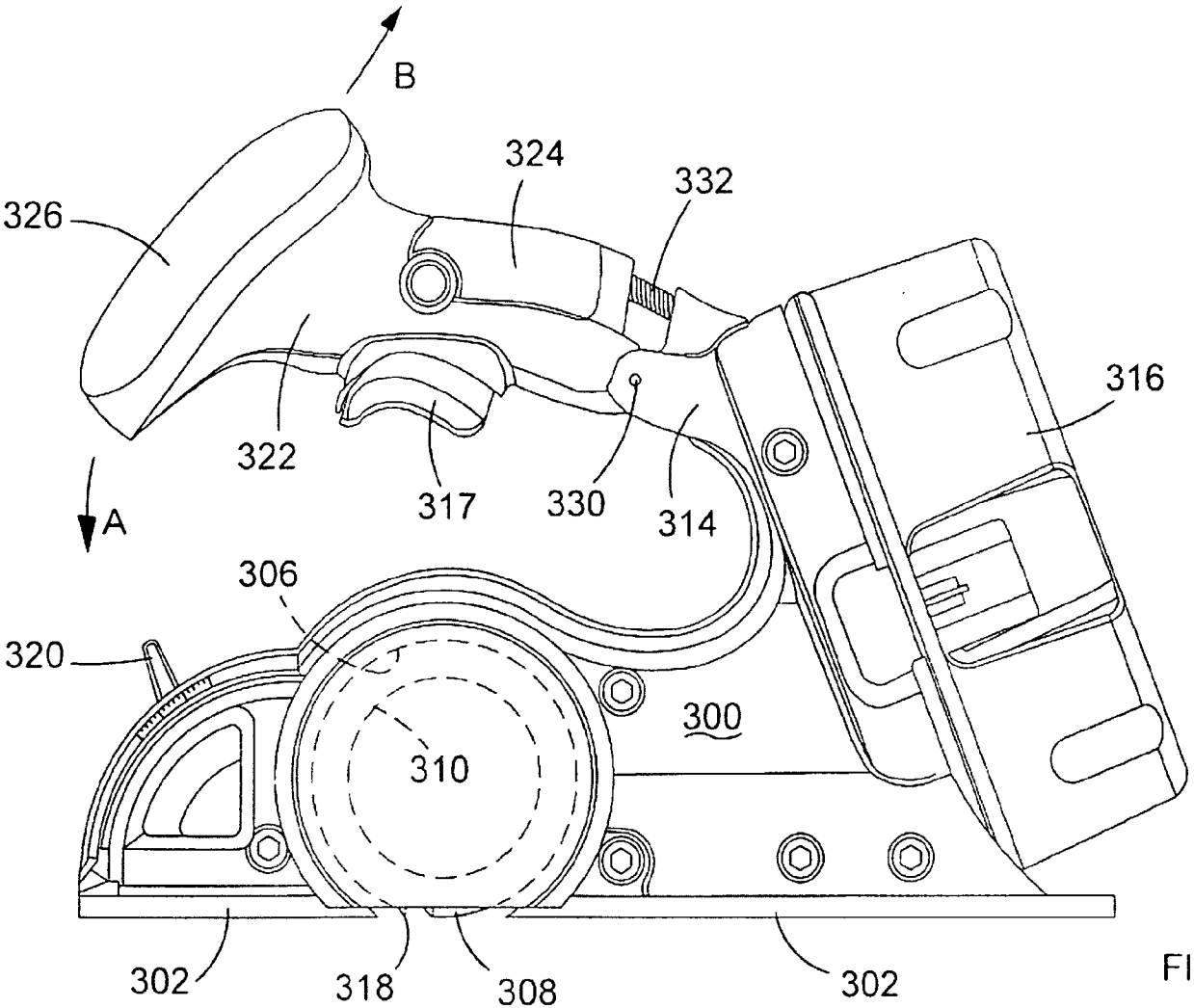
FIG. 17 shows a side view of the planer according to the second embodiment of the present invention.

A second embodiment of the invention will now be described with reference to FIG. 17. Where to same features are present in the second embodiment which were present in the first, the same reference numbers have been used. There are two differences between the first and second embodiments.

Firstly, the electric motor 310 and the cutting drum 306 have been integrated in the same manner as that in the planer described previously with reference to FIGS. 2 to 12.

Secondly, the shaft 322 in the second embodiment of the rear handle is rigid along the whole of its length. However, the shaft 322 is attached to the rear 314 of the housing 300 via a pivot 330. This enables the shaft 322, grip 324 and front handle 326 to pivot toward or away from the housing 300. A helical spring 332 is connected between the shaft 322 and rear 314 of the housing and resiliently biases the shaft to a predetermined position as shown in FIG. 17. The spring 332 provides a biasing force against the movement of the shaft 322 toward or away from the housing 300. The spring also acts as a vibration dampener, reducing the amount of vibration transferred from the housing 300 to the shaft 322.

What is claimed is:

1. A hand held electrically powered planer comprising:

a housing;

an electric motor mounted within the housing;

a work piece engaging shoe mounted on the underside of the housing having an aperture formed through it;

a cutting drum rotatably mounted within the housing, which is capable of being rotatably driven by the electric motor when the electric motor is activated, wherein a part of the cutting drum protrudes through the aperture to engage with a work piece;

a cutting blade mounted on the cutting drum;

a rear handle mounted on the housing wherein;

the rear handle comprises a cantilevered elongate shaft attached at one end only to the rear of the housing and which extends forward in a lengthwise direction over a portion of the housing toward the front end of the housing; and a grip mounted or formed on the elongate shaft, wherein there is provided a front handle which is mounted on a free end of the shaft forward of the grip, wherein the front handle is integrally formed on the free end of the shaft, and wherein the shaft is resiliently mounted on the housing to allow the grip and the front handle to move against a biasing force toward or away from the housing.

2. The hand held electrically powered planer as claimed in claim 1, wherein the shaft is mounted on the housing using a pivot and there is further provided a biasing means connected between the shaft and the housing to bias the shaft to a predetermined position while allowing at least one of the grip and front handle to move against the biasing force of the biasing means toward or away from the housing.

3. The hand held electrically powered planer as claimed in claim 1, wherein at least a part of the shaft is resilient to allow at least one of the grip and front handle to move against a biasing force toward or away from the housing.

4. A hand held electrically powered planer comprising:

a housing;

an electric motor mounted within the housing;

a work piece engaging shoe mounted on the underside of the housing having an aperture formed through it;

a cutting drum rotatably mounted within the housing, which is capable of being rotatably driven by the electric motor when the electric motor is activated, wherein a part of the cutting drum protrudes through the aperture to engage with a work piece;

a cutting blade mounted on the cutting drum;

a rear handle mounted on the housing wherein;

the rear handle comprises a cantilevered elongate shaft attached at one end only to the rear of the housing and which extends forward in a lengthwise direction over a portion of the housing toward the front end of the housing; and a grip mounted or formed on the elongate shaft, wherein there is provided a front handle which is mounted on a free end of the shaft forward of the grip, wherein the shaft is resiliently mounted on the housing to allow the grip and the front handle to move against a biasing force toward or away from the housing.

5. The hand held electrically powered planer as claimed in claim 4, wherein the shaft is mounted on the housing using a pivot and there is further provided a biasing means connected between the shaft and the housing to bias the shaft to a predetermined position while allowing at least one of the grip and front handle to move against the biasing force of the biasing means toward or away from the housing.

6. The hand held electrically powered planer as claimed in claim 1, wherein at least a part of the shaft is resilient to allow at least one of the grip and front handle to move against a biasing force toward or away from the housing.

7. The hand held electrically powered planer as claimed in claim 1, further comprising a battery mounted on the housing to power the motor.

8. The hand held electrically powered planer as claimed in claim 1, further comprising a trigger switch mounted on shaft which can be used to activate the electric motor.

9. The hand held electrically powered planer as claimed in claim 1, wherein the electric motor is integral with the cutting drum.

* * * * *